US005794543A

United States Patent [19]

John et al.

[11] Patent Number: 5,794,543

[45] Date of Patent: Aug. 18, 1998

[54] MODULAR PALLET SYSTEM

[75] Inventors: Michael John, Boca Raton; Robert V. Daigle, Deerfield, both of Fla.

[73] Assignee: Johnson & Ruddick, Ltd., Cayman Islands

[21] Appl. No.: 562,507

[22] Filed: Nov. 24, 1995

Related U.S. Application Data

[63] Continuation-in-part of Ser. No. 523,639, Sep. 5, 1995.

[51] Int. Cl.[6] ..... B65D 19/00

[52] U.S. Cl. ..... 108/56.1; 108/56.3; 108/901

[58] Field of Search ..... 108/56.1, 56.3, 108/51.1, 902, 901

[56] References Cited

U.S. PATENT DOCUMENTS

| | | | |
|---|---|---|---|
| 3,857,342 | 12/1974 | Johns | 108/56.1 X |
| 4,597,338 | 7/1986 | Kreeger | 108/902 X |
| 4,604,014 | 8/1986 | Frano | 108/56.3 X |
| 5,197,395 | 3/1993 | Pigott et al. | 108/56.1 |
| 5,388,533 | 2/1995 | Pigott et al. | 108/56.1 X |
| 5,483,899 | 1/1996 | Christie | 108/56.3 |

FOREIGN PATENT DOCUMENTS

| | | | |
|---|---|---|---|
| 2326607 | 4/1977 | France | 108/56.1 |

*Primary Examiner*—Jose V. Chen
*Assistant Examiner*—Janet M. Wilkens
*Attorney, Agent, or Firm*—M. K. Silverman

[57] ABSTRACT

A modular pallet system is definable in terms of an xyz Cartesian matrix. The system includes a bottom element having a xy plane primary surface and integrally dependent positive z-axis prongs substantially at each of x and y axis edges of the primary surface, each of the prongs having first integral complemental engagement at their ends. The system further includes a top element having a rectilinear primary surface having opposing x and y axis edges, the surface positionable in a second xy plane above the first xy plane of the bottom element, the top element having integrally dependent negative z-axis prongs projecting from each of the x and y axis edges of the second xy plane thereof, each of the prongs terminating with second integral complemental engagement elements. The pallet system further includes hollow box-like z-axis separators having pairs of opposing xz and yz walls on interior surfaces of the walls including elements for snap-fittable securement with outer surfaces of the second complemental engagement elements of the prongs of the top element. Yet further included is a base layer comprising x-axis and y-axis linear offset members for defining x and y axis dimensions between pluralities of the separators. The system also includes a top layer positionable in the xy plane of the top element, such layer having openings therein proportioned for engagement between edges of the top element and top edges of the box-like separators. Upon interlock of opposing surfaces of the complemental engagement elements of the top and bottom elements within the volume defined by the separators, and the interlock of outer surfaces of the engagement elements of the prongs of the top element to the snap-fittable interlock elements of the separators, a structure having rigid xy, xz and yz planes is defined.

5 Claims, 17 Drawing Sheets

MODULAR PALLET SYSTEM

REFERENCE TO RELATED APPLICATION

This case is a continuation-in-part of application Ser. No. 08/523,639, filed Sep. 5, 1995, entitled Modular Pallet System.

BACKGROUND OF THE INVENTION

Pallets are flat, typically two-layered rigid articles employed in the transportation and storage of a vast variety of consumer and industrial products and materials. Pallets are typically attached to cartons or packaging of the product or supply of interest at the site of production or origination of a partially or fully manufactured product. The pallet assures that the product will be shipped and stored in a physical relationship to the pallet that is generally defined by the manufacturer thereof. Further, movement of products and materials associated with a given pallet can be effected through the use of the prongs of a forklift vehicle to facilitate the movement on and off of transportation vehicle means and for re-positioning of pallets and their associated materials within warehouses. Accordingly, it is to be appreciated that pallets have, in the present industrial period, become the predominant manner in which a majority of the industrial output of the world is transported from a point of manufacture, onto transportation means, and finally into and within warehousing facilities, and therefrom to the end user or retailing establishment.

The norm in pallet construction has been that of wood planks and beams, connected by nails and screws. The problems of such prior art pallets have been many, these including without limitation that:

1. The weight of wooden pallet is excessive, thereby giving rise to problems of cost and risk of injury.

2. Wooden pallets cannot be modularized.

3. Projecting nails, and screws and splinters present a safety problem.

4. The life of wood in typical pallet use is quite limited, e.g., six weeks.

5. Damaged wooden pallets are difficult to repair.

6. Wooden pallets are not easily disposed of.

7. Such pallets cannot be readily recycled, this due primarily to the presence of nails and screws embedded within the wood structure thereof.

8. Due to susceptibility of wood to infestation, many countries require costly fumigation of all pallet-containing imports.

Notwithstanding the relatively nominal cost (about $4.00 to $40.00) of various wooden pallets, the above problems have given rise to a need in the art for a modular pallet, that is, one in which the parts thereof may be readily replaced when damaged, for a pallet having a considerable longer life and resistance to hostile environments than the traditional wood pallet, and for one that can be completely recycled in response to environmental concerns.

There does not exist to the knowledge of the inventors any prior art which teaches a modular pallet system which responds to the above set forth areas of long felt need in the art.

SUMMARY OF THE INVENTION

The present invention relates to a modular pallet system which is definable in terms of an xyz Cartesian matrix. The system includes a plurality of components, each of such components including a bottom element having a rectilinear primary surface having opposing x and y axis edges, said surface positionable in a first xy plane, said element having integrally dependent positive z-axis prongs located substantially at each of said x and y axis edges of said primary surface, each of said prongs terminating, at a positive z-axis end thereof, with first integral complemental engagement means. Each component of the pallet system also includes a top element having a rectilinear primary surface having opposing x and y axis edges, said surface positionable in a second xy plane, above said first xy plane, said element having integrally dependent negative z-axis prongs substantially at each of said x and y edges of said primary surface, each of said prongs terminating, at a negative z-axis end thereof, with second integral complemental engagement means, having inner and outer surfaces, the inner surface of each of said second engagement means proportioned for snap-fittable interlock with a surface of corresponding one of said first engagement means of said prongs of said bottom element. Each of said components further includes a hollow box-like z-axis separation means having pairs of opposing xz and yz walls, and an open top and bottom within xy planes thereof, said walls and planes proportioned for internestable support of said primary surfaces of said top and bottom elements, interior surfaces of each of said walls including integrally dependent means for snap-fittable interlock with said outer surfaces of said second complemental engagement means of said prongs of said top element. Upon interlock of said complemental engagement means of said prongs to each other within a volume defined by said separation means, and the interlock of said outer surfaces of said second surfaces of said prongs of said second engagement means to said snap-fittable interlock means of said separation means, a structure having rigid xy, xz and yz surfaces is thereby formed. The x and y axis spacing between each of the above defined components and the base layer of the system is established by a xy axis matrix of linear offset members, each of said members having openings therein proportioned for engagement between edges of said first xy plane of said bottom element and base edge of said box-like z-axis separation means. A top layer of the system is established by quadrants of a honeycomb-like surface in said second xy plane, which has openings therein proportioned for engagement between edges of said top element and a top edge of said separation means.

It is an object of the present invention to provide a modular pallet system having enhanced cost-effectiveness of usage relative to prior art non-modular and wooden pallets.

It is another object to provide a pallet system which may be readily repaired by replacing only damaged portions thereof.

It is a further object of the invention to provide a pallet system having enhanced durability over prior art pallets.

It is a still further object to provide a pallet system that can be shipped in component parts and then assembled at a destination without need for tools or special hardware.

It is a yet further object of the invention to provide a pallet system which, after its life cycle, may be completely recycled.

It is another object to provide a pallet system which will not pose safety problems associated with the use of sharp metal articles, such as bolts, screws, and rivets embedded within wooden and non-modular pallet structures.

The above and yet other objects and advantages of the present invention will become apparent from the hereinafter set forth Brief Description of the Drawings, Detailed Description of the Invention and claims appended herewith.

DETAILED DESCRIPTION OF THE INVENTION

Figure 1:
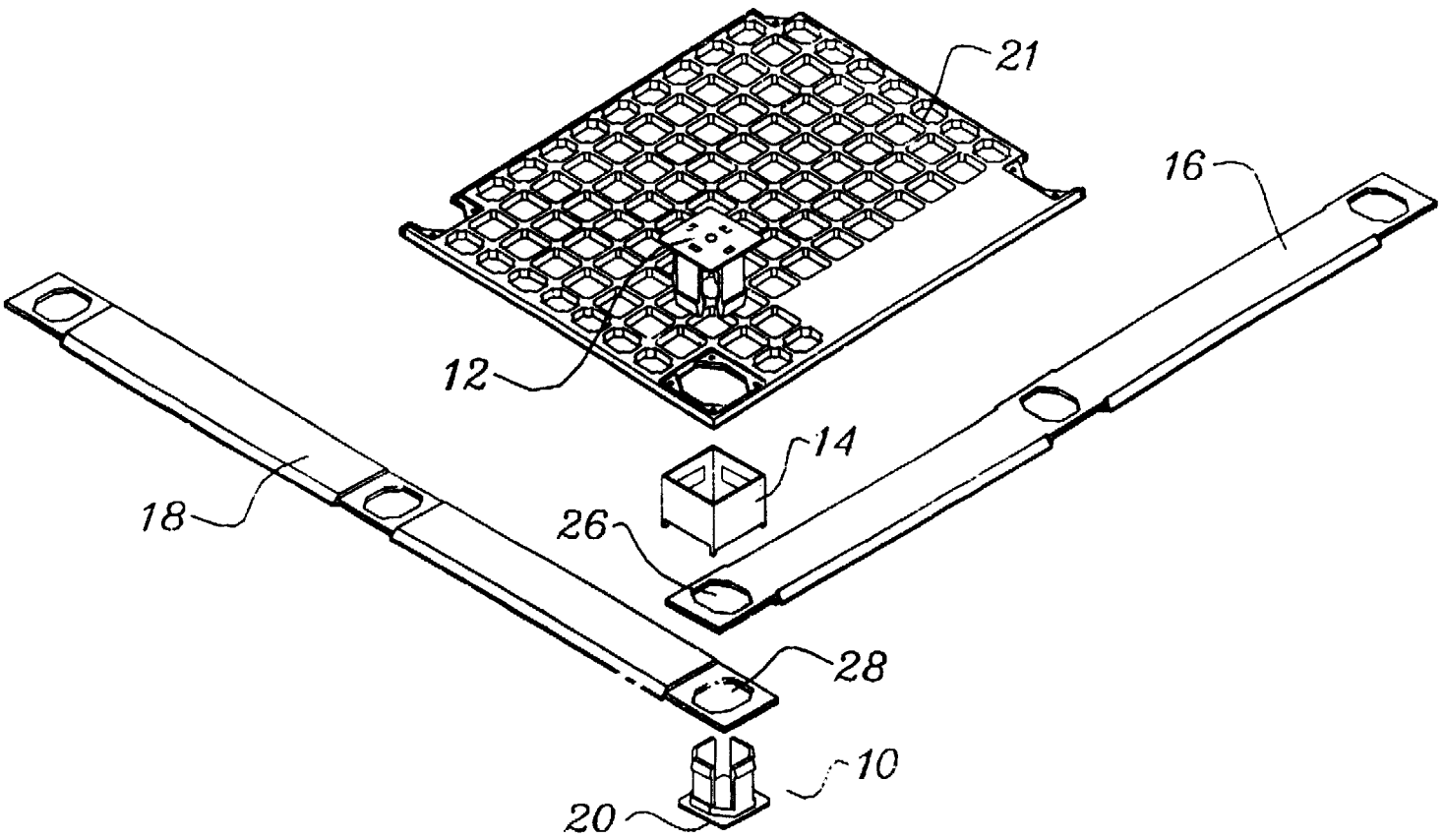
FIG. 1 is an exploded view showing the material elements of the present invention.

With reference to the exploded view of FIG. 1 there may, therein, be seen all of the material elements of the instant inventive modular pallet system. At the lower right of FIG. 1, there is shown an zyz axis Cartesian system to which reference is made below in referring to the orientation and position of the respective elements of the pallet system.

More particularly, there is, in FIG. 1 shown a bottom element 10, a top element 12, a box-like z-axis separation means 14, a base layer defining x-axis linear offset member 16, a base layer defining y-axis linear offset member 18, and a quadrant of a top layer defining honeycomb structure 20.

Figure 2:
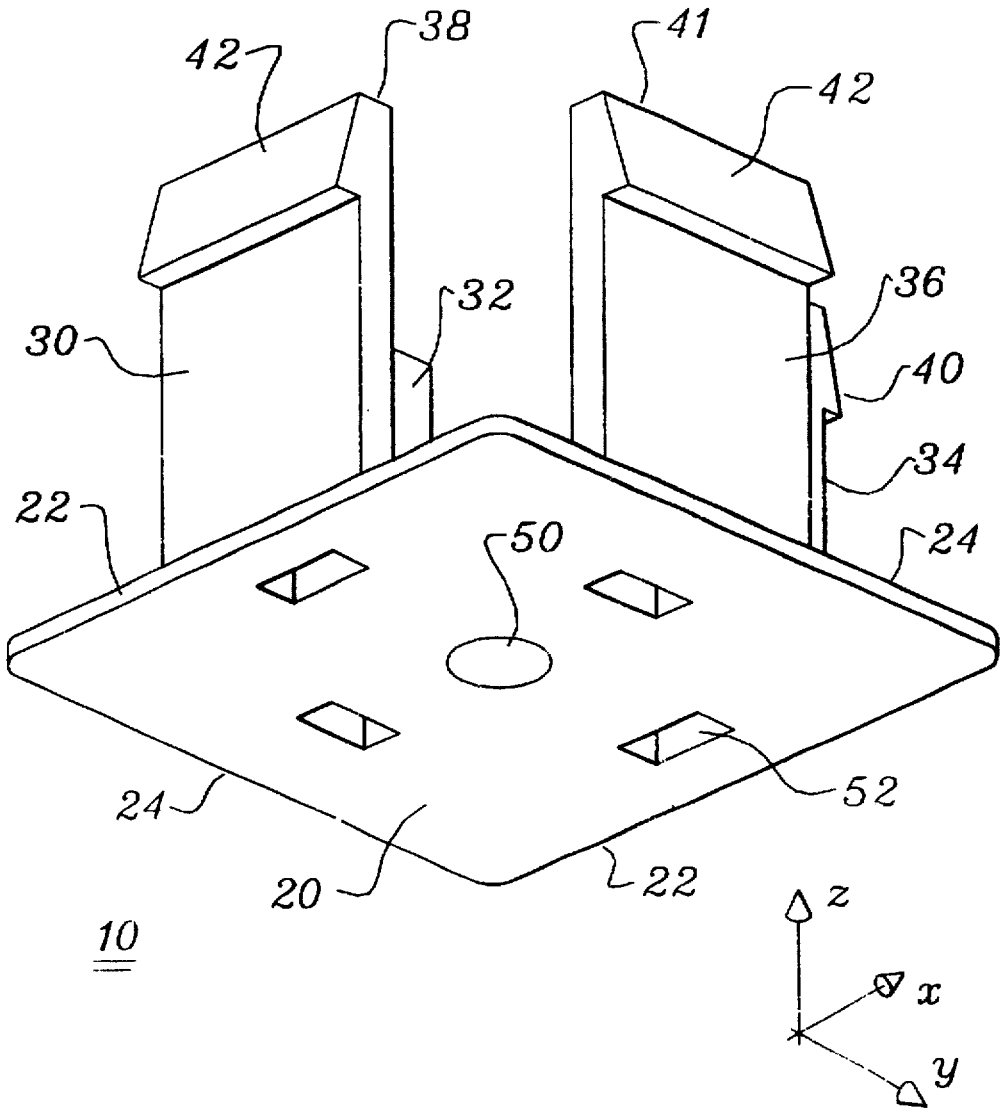
FIG. 2 is a perspective view of the bottom elements of the inventive pallet system.
Figure 3:
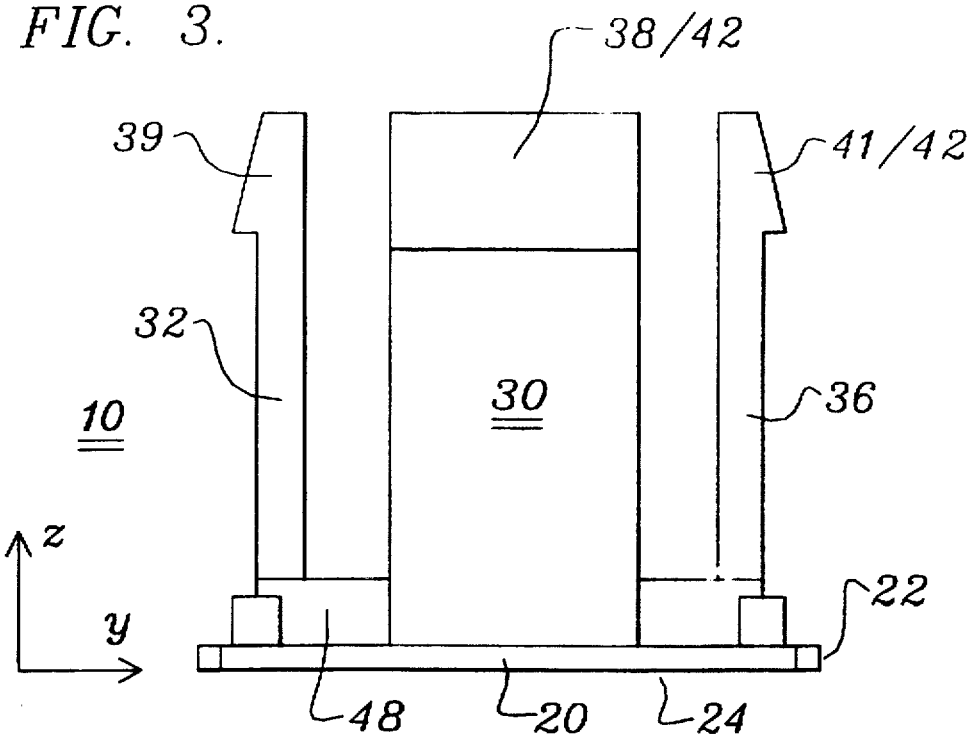
FIG. 3 is a side plan view in the yz plane of the bottom element shown in FIG. 2.
Figure 4:
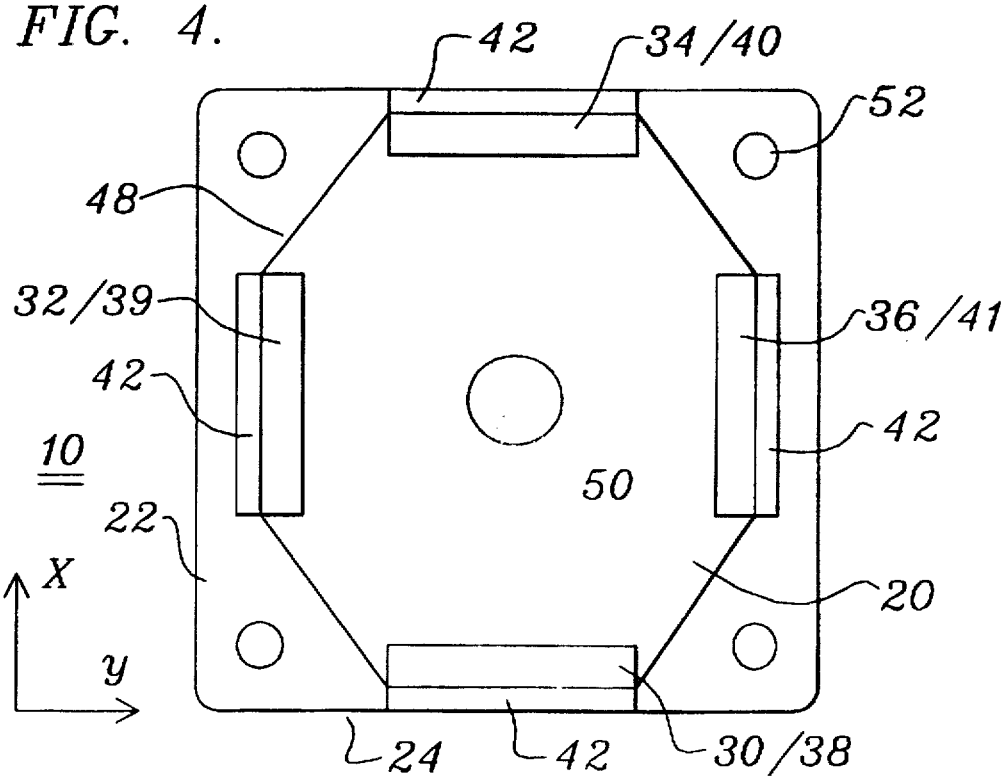
FIG. 4 is a top plan view thereof.

The bottom element 10 may be more fully appreciated with reference to the perspective, side and top views of FIGS. 2, 3 and 4. There is, in said views, shown a rectilinear primary surface 20 having opposing x-axis edges 22 and y-axis edges 24. Said primary surface 20 is positionable in a first xy plane (see FIG. 1) which is a plane which defines the bottom layer of the present pallet system. In other words, as is more fully described below, said primary surface 20 of the bottom element 10 is substantially co-planer with the plane of the linear offset members 16 and 18 when said bottom element 10 has been fully inserted into openings 26 and 28 of the linear offset members 16 and 18 respectively.

With further reference to FIGS. 2 to 4, the bottom element 10 may be seen to further include integrally dependent positive z-axis prongs 30, 32, 34 and 36, each of which originate at or near the x-axis edges 22 and y-axis edges 24 of the bottom element.

As may be noted in FIGS. 2 to 4, each of said z-axis prongs 30 to 36 terminates, at a positive z-axis end thereof, with first integral complemental engagement means 38, 39, 40 and 41 respectively. As may be noted, there exist exterior engagement surfaces 42 for each of said first engagement means 38 to 40. See FIGS. 3 and 4.

As may be noted in the top plan view of FIG. 4, the positive z-axis prongs are arranged within a substantially octagonal perimeter 48 for the purpose of which is to nest within the substantially octagonally geometry of said openings 28 and 26 in the x-axis linear members 26 and y-axis linear offset members 28.

Also shown in the view of FIG. 4 are holes 50 and 52, the purpose of which is to facilitate disassembly of the present structure in the manner more fully set forth below.

Figure 5:
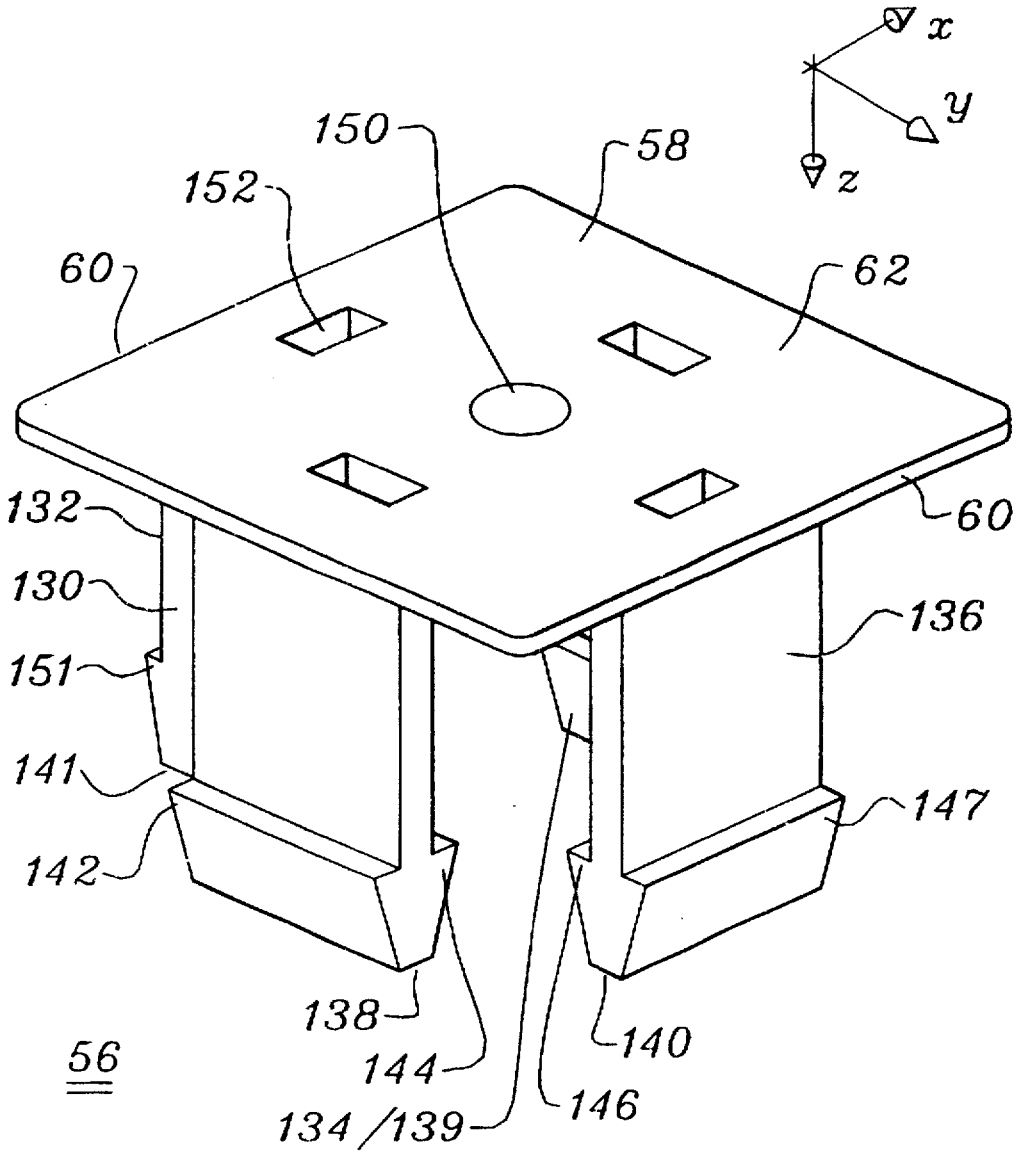
FIG. 5 is a perspective view of the top element of the pallet system.
Figure 6:
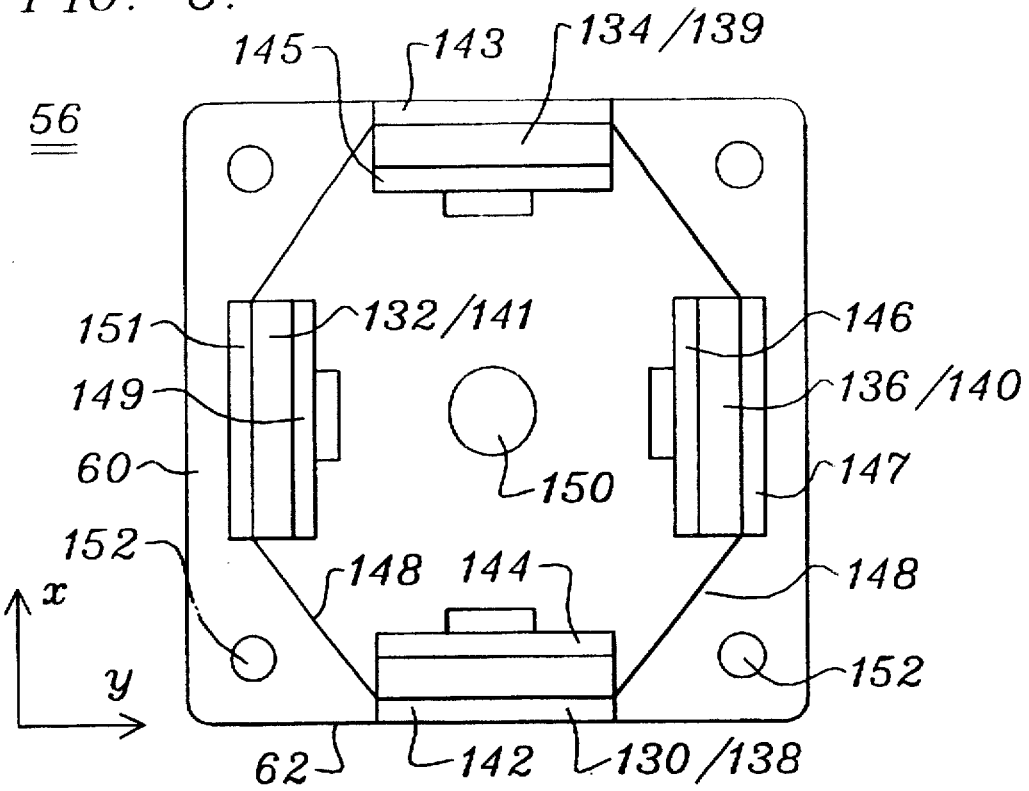
FIG. 6 is a bottom plan view thereof.
Figure 7:
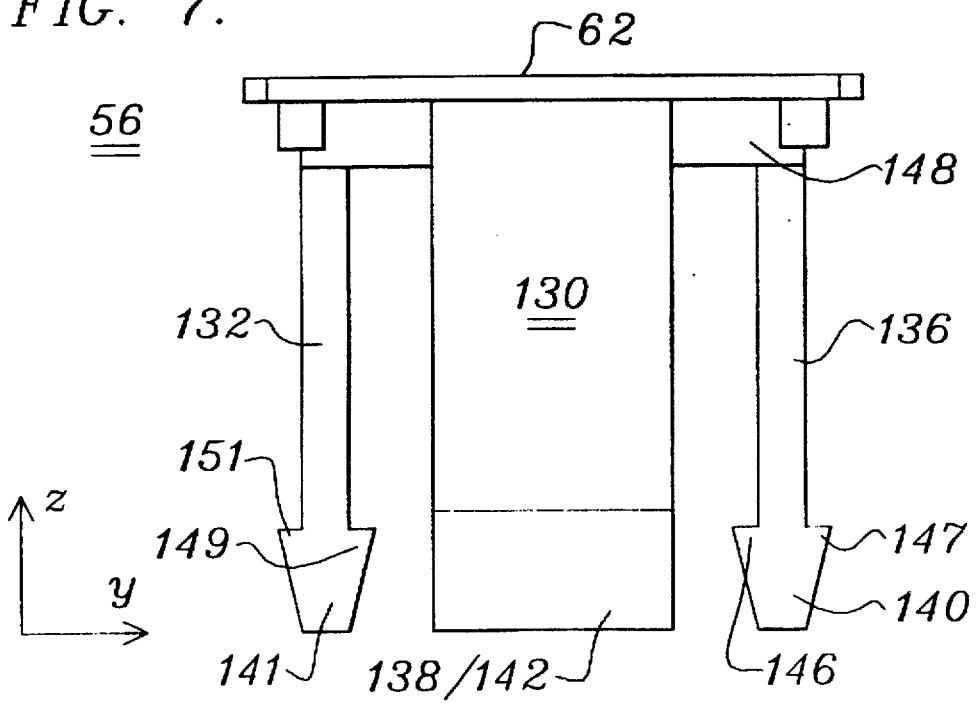
FIG. 7 is a side plan view thereof.

With regard to the views of FIGS. 5 thru 7, there is shown top element 56 of the modular pallet system. As may be noted, top element 56 is similar as bottom element 10, however, inverted, and the prongs thereof are further from each other to permit coupling between top and bottom elements, as is more fully described below.

The top element 56 of the inventive modular pallet system includes a rectilinear primary surface 58 having opposing x-axis edges 60 and y-axis edges 62. Said surface 58 is positionable in a second xy plane, above said first xy plane of said primary surface 20 of said bottom element 10.

The top element 56 exhibits integrally dependent negative z-axis prongs 130, 132, 134 and 136. Each of said prongs terminates, at negative z-axis ends thereof, with second integral complemental engagement means 138, 141, 139 and 140 respectively (see FIG. 6). It may, therefrom, be appreciated that each of the second complemental engagement means 138 to 141 exhibits inner inclined surfaces 144, 149, 145 and 146 respectively and exhibit outer inclined surfaces 142, 151, 143, and 147 respectively. The result of this geometry is the arrow-like prongs which appear in FIG. 5, as engagement means 138, 141, 139, and 140. The result of this structure is the arrow-like prong geometry at the end of prongs 130 and 134.

It is to be appreciated that said inner surfaces of said negative z-axis engagement means of element 56 are proportioned for snap-fittable interlock with outer surfaces of the positive z-axis engagement means 30, 32, 34 and 36 of bottom element 10.

Figure 11:
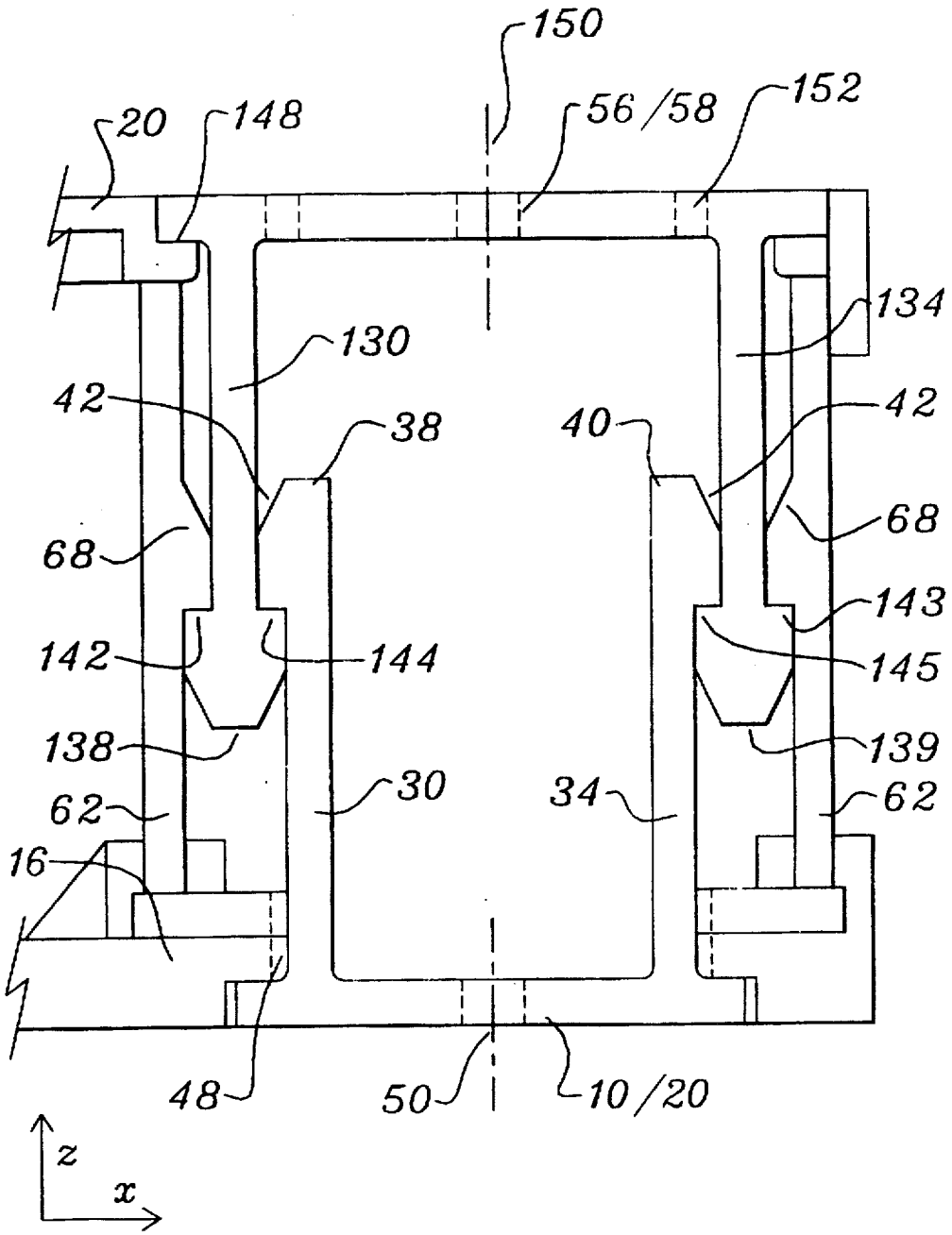
FIG. 11 is vertical cross-sectional assembly view showing the mechanical coupling between the complemental engagement means of the bottom element, top element and inner walls of the z-axis separation means in the xz plane.

The nature of this interlock may be more fully appreciated with reference to the xz cross-sectional assembly view of FIG. 11 which shows the snap-fittable lock between outer surface 42 of said first complemental engagement means 38 of prong 30 of lower element 10 with surface 144 and second complemental engagement means 138 of prong 130 of top element 56. Similarly, to the right of FIG. 11, it may be seen that outer surface 42 of first complemental engagement means 40 of prong 34 of bottom element 10 snap fittably interlocks with inner surface 145 of second complemental engagement means 139 of prong 134 of top element 56.

Figure 12:
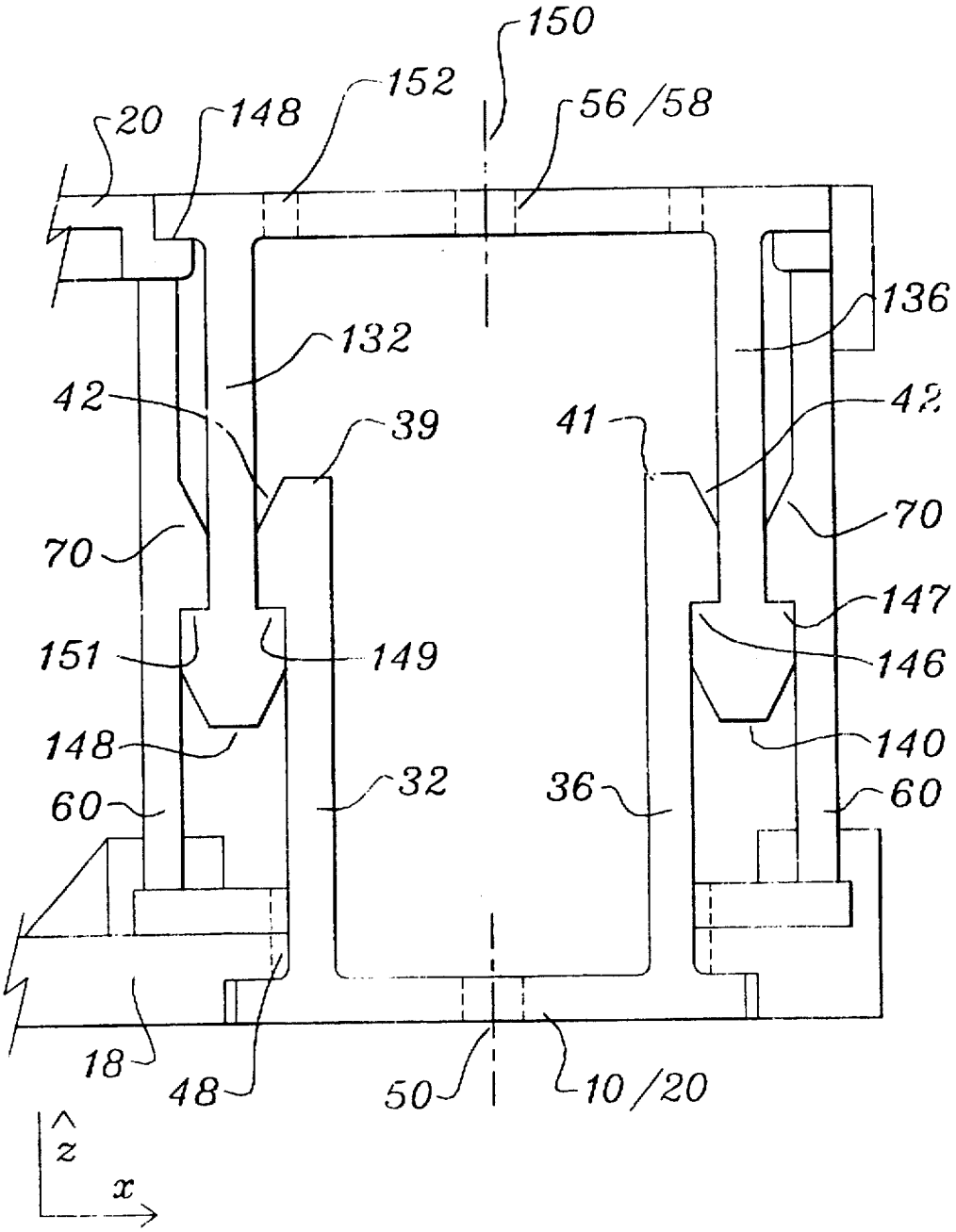
FIG. 12 is a view, similar to the view of FIG. 11, however, rotated ninety degrees about the z-axis therefrom.

The nature of the interlock between the bottom element 10 and top element 56 may be further appreciated with reference to the xz axis cross-sectional assembly view of FIG. 12 which, at the left side thereof, shows the snap-fittable lock between, outer surface 42 of first complemental engagement means 39 of prong 32 of lower element 10, and inner surface 149 of second complemental engagement means 141 of prong 132 of top element 56. Similarly, to the right of FIG. 12, it may be seen that outer surface 42 of first complemental engagement means 41 of prong 36 of bottom element 10 snap-fittably interlocks with inner surface 146 of second complemental engagement means 140 of prong 136 of top element 56. Accordingly, each complemental engagement means of the bottom element is locked, at an outer surface thereof, to an opposing inner surface of each complemental engagement means of the top element.

Figure 8:
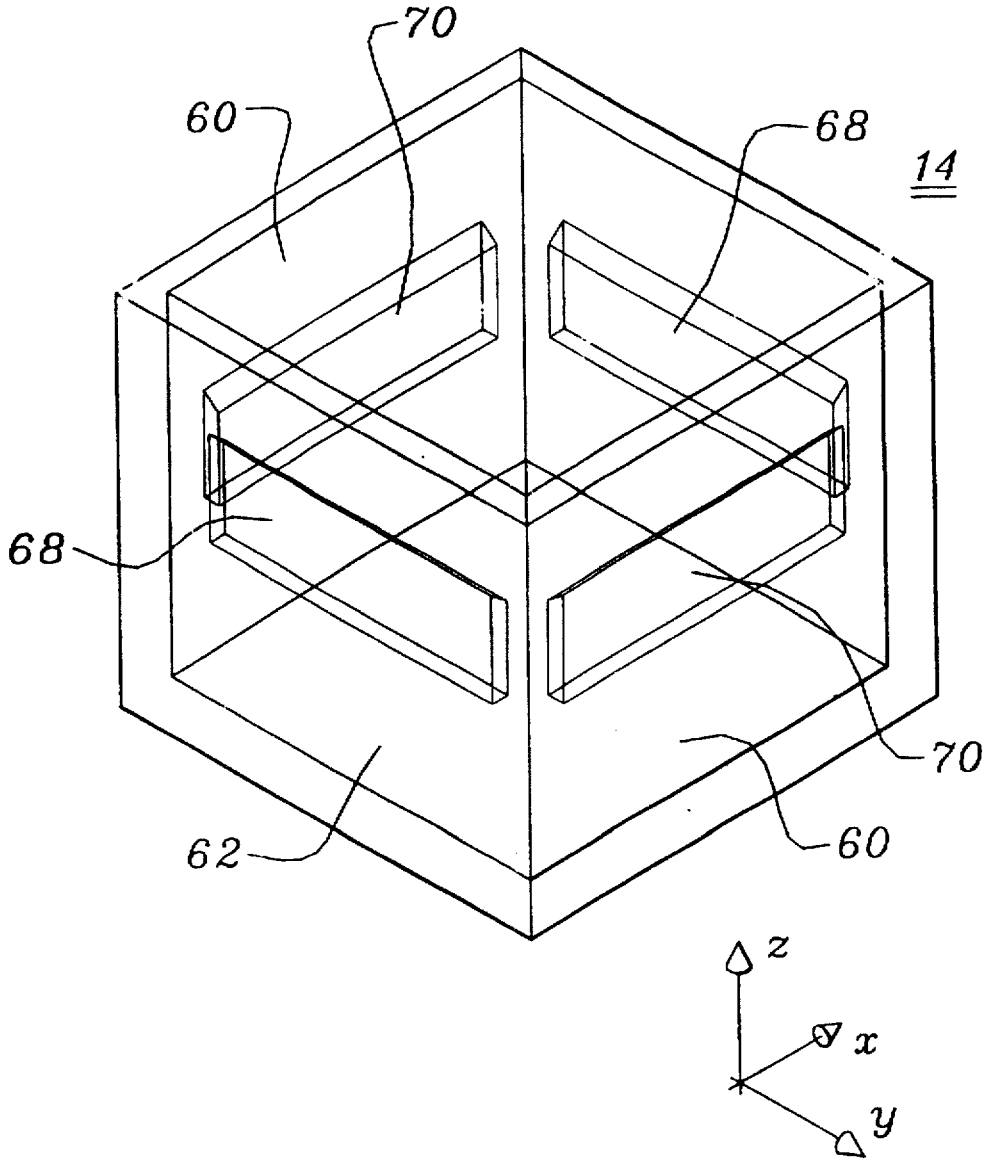
FIG. 8 is perspective view of the box-like separation means of the present pallet system.
Figure 9:
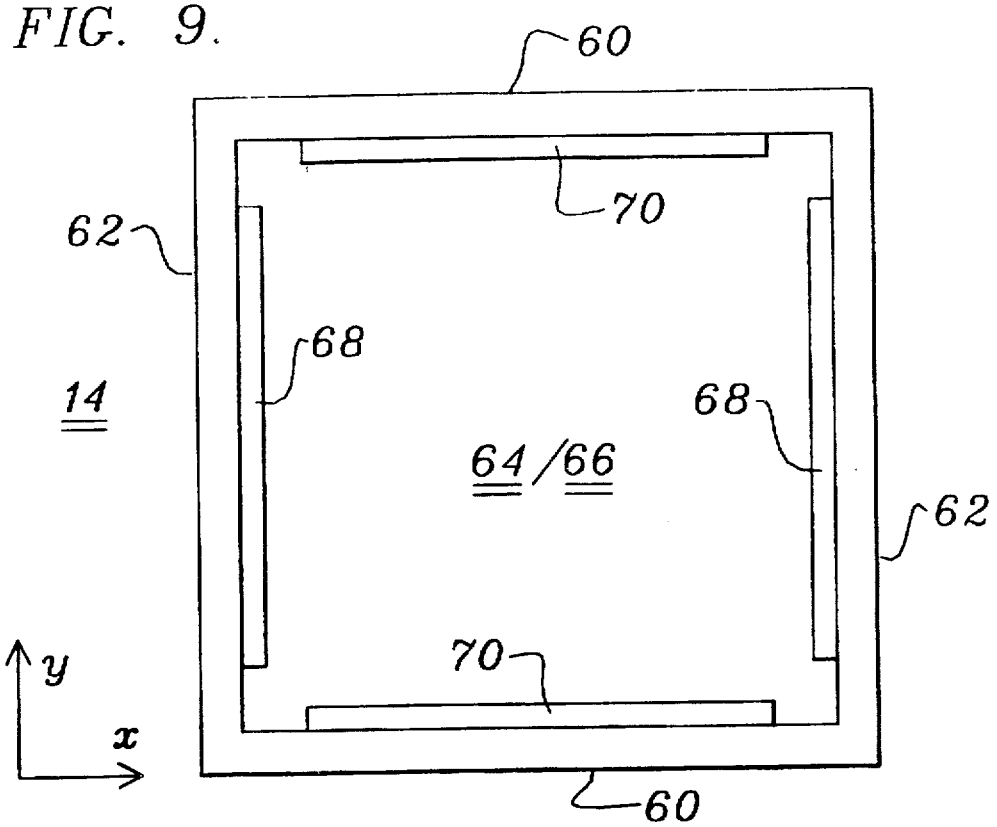
FIG. 9 is a top plan view thereof.
Figure 10:
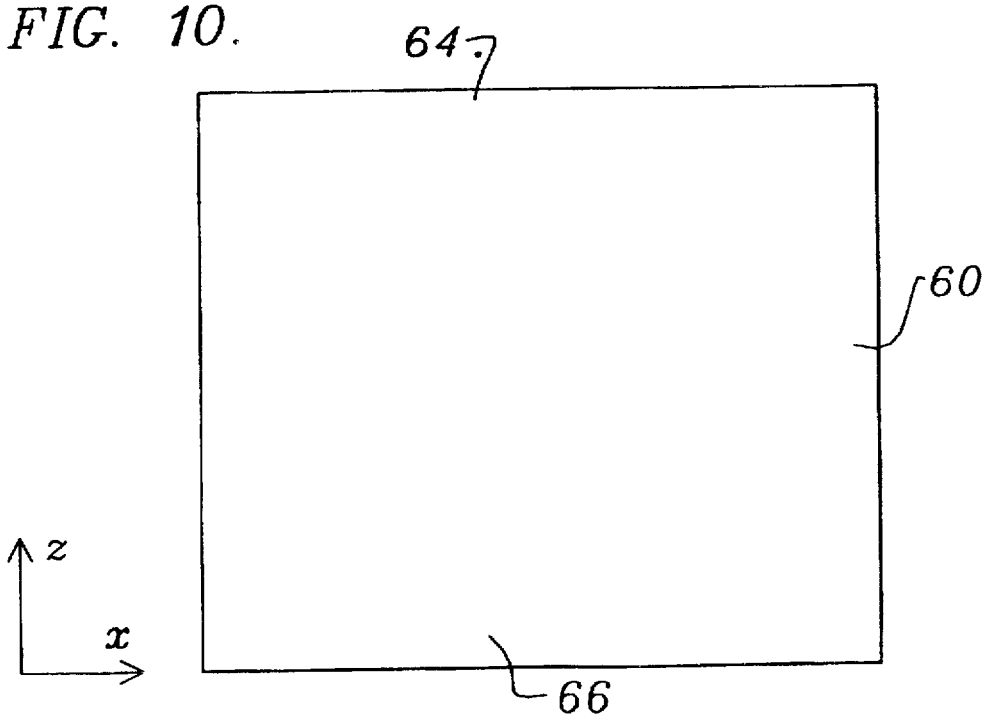
FIG. 10 is side plan view thereof.

A further material part of the inventive pallet system is shown in the perspective view of FIG. 8, that is, the box-like separation means. The separation means 14, more particularly, includes opposing xz axis walls 60 and opposing yz axis walls 62. Also, as may be noted, the separation means 14 is hollow throughout all interior xy planes 64/66 thereof. As may be noted in said view of FIG. 8, as well as in the top plan view of FIG. 9, the interior of the separation means 14 is provided with integrally-dependent means for snap-fittable interlock with outer surfaces of said second complemental engagement means of the prongs of the top element. More particularly, the interior of yz walls 62 are provided with integrally dependent means 68 for snap-fittable interlock, and the interior of xz plane walls 60 are provided with integrally dependent means 70 for snap-fittable interlock.

The relationship of said interlock means 68 and 70 to the complemental engagement means 138 to 141 of the prongs 130 to 136 of the top element may be more particularly seen with reference to the cross-sectional assembly views of FIGS. 11 and 12. Therein, as may be noted in FIG. 11, the snap fittable interlock means 68 of wall 62 of separation means 14 mates with outer surfaces 142 and 143 of second complemental engagement means 138 and 139 respectively. Similarly, in the xy plane, as may be noted in FIG. 12, interlock means 70 of the xz axis walls of the separation means 14 mate with outer surfaces 151 and 147 of second complemental engagement means 141 and 140 respectively of prongs 132 and 136 respectively of the top element 56. Accordingly, there is created a structure having rigid xy, xz, and yz surfaces.

Figure 13:
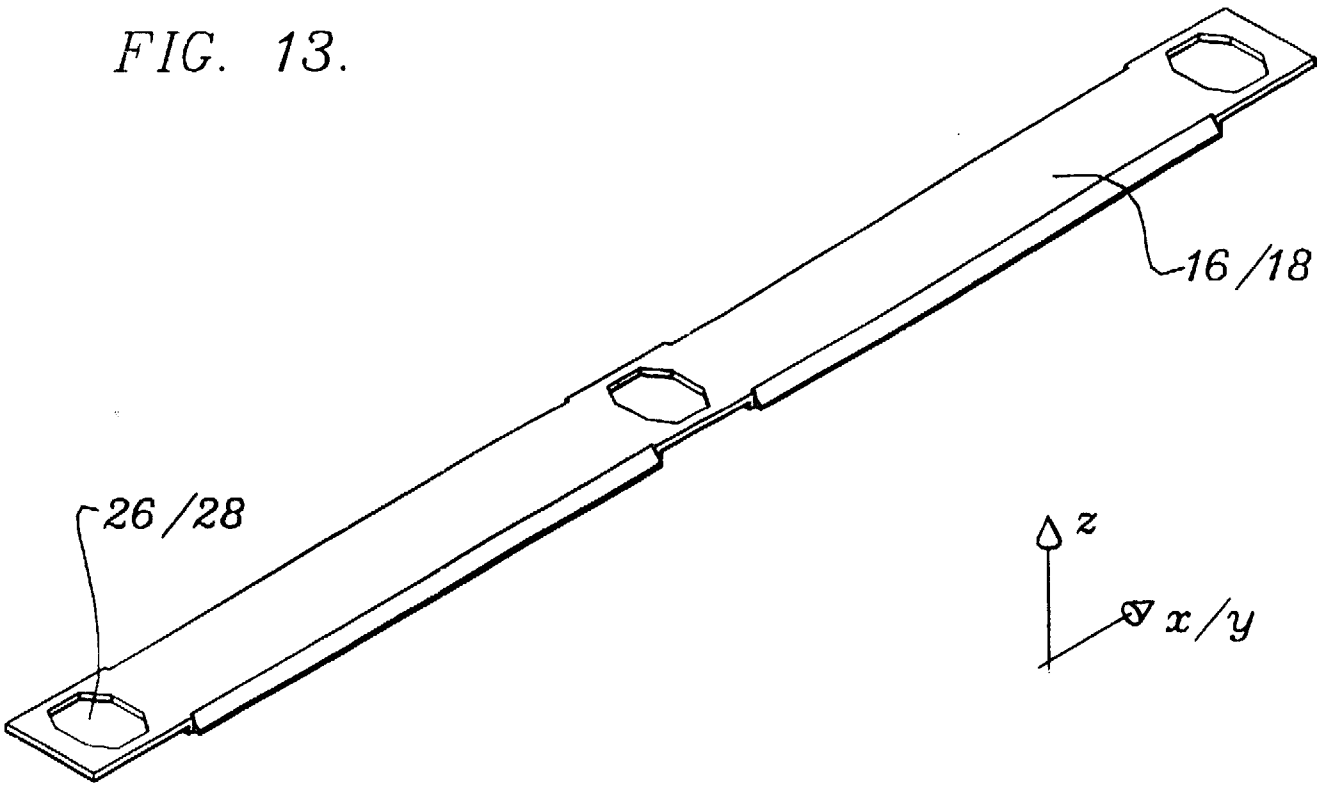
FIG. 13 is a perspective view showing the top surfaces of the x and y axis linear offset members of the pallet system.
Figure 14:
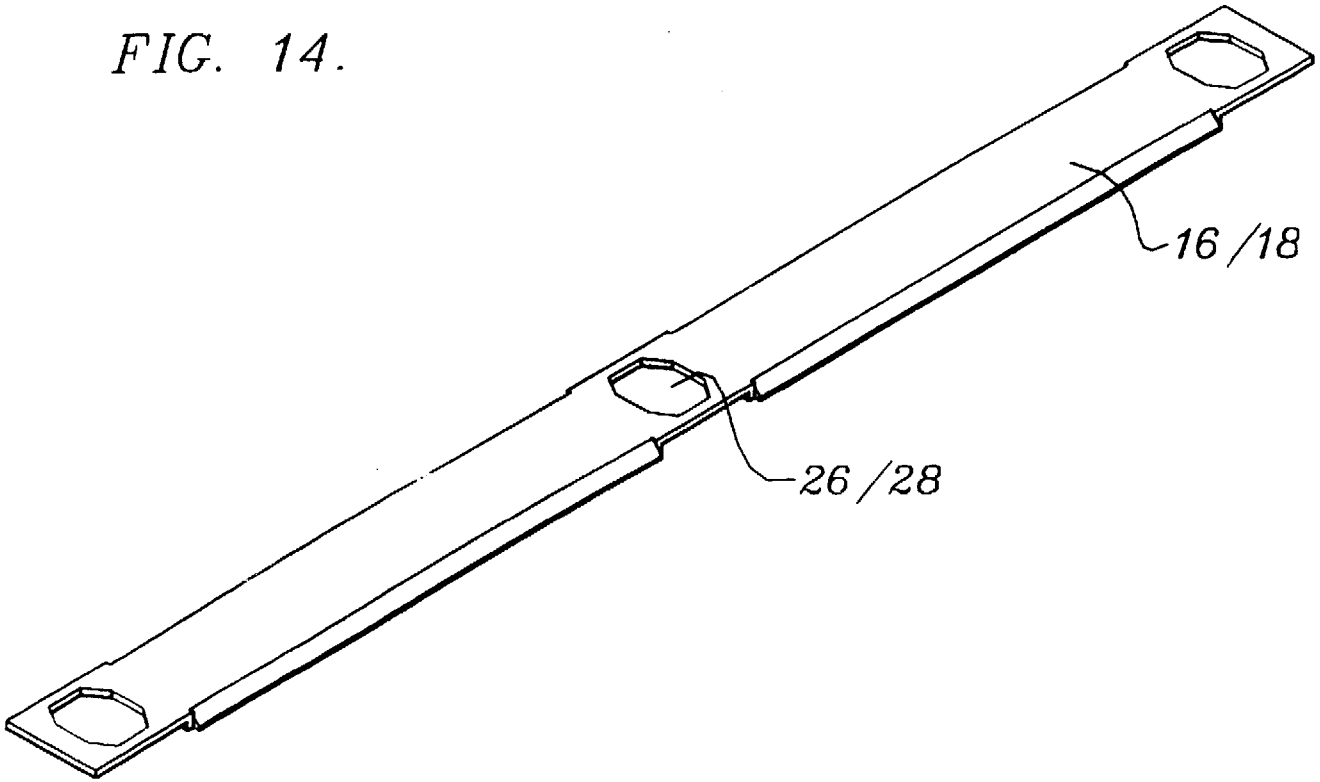
FIG. 14 is a bottom view of the linear offset member shown in FIG. 13.

It should be further noted in the cross-sectional assembly views of FIGS. 11 and 12 that the octagonal perimeter 48 of the prongs 30 thru 36 enable the nesting of bottom element 10 within said opening 26 and 28 of the respective x and y axis linear offset members 16 and 18 (see lower left of FIGS. 11 and 12). The appearance of the linear offset members 16 and 18 may be more particularly seen with reference to the views of FIGS. 13 and 14 in which FIG. 13 is a top perspective view of a representative linear offset member and FIG. 14 is a bottom view thereof. As may be appreciated, the x and y linear offset members differ only in the distance between the octagonal openings 26 and 28 therein.

Figure 15:
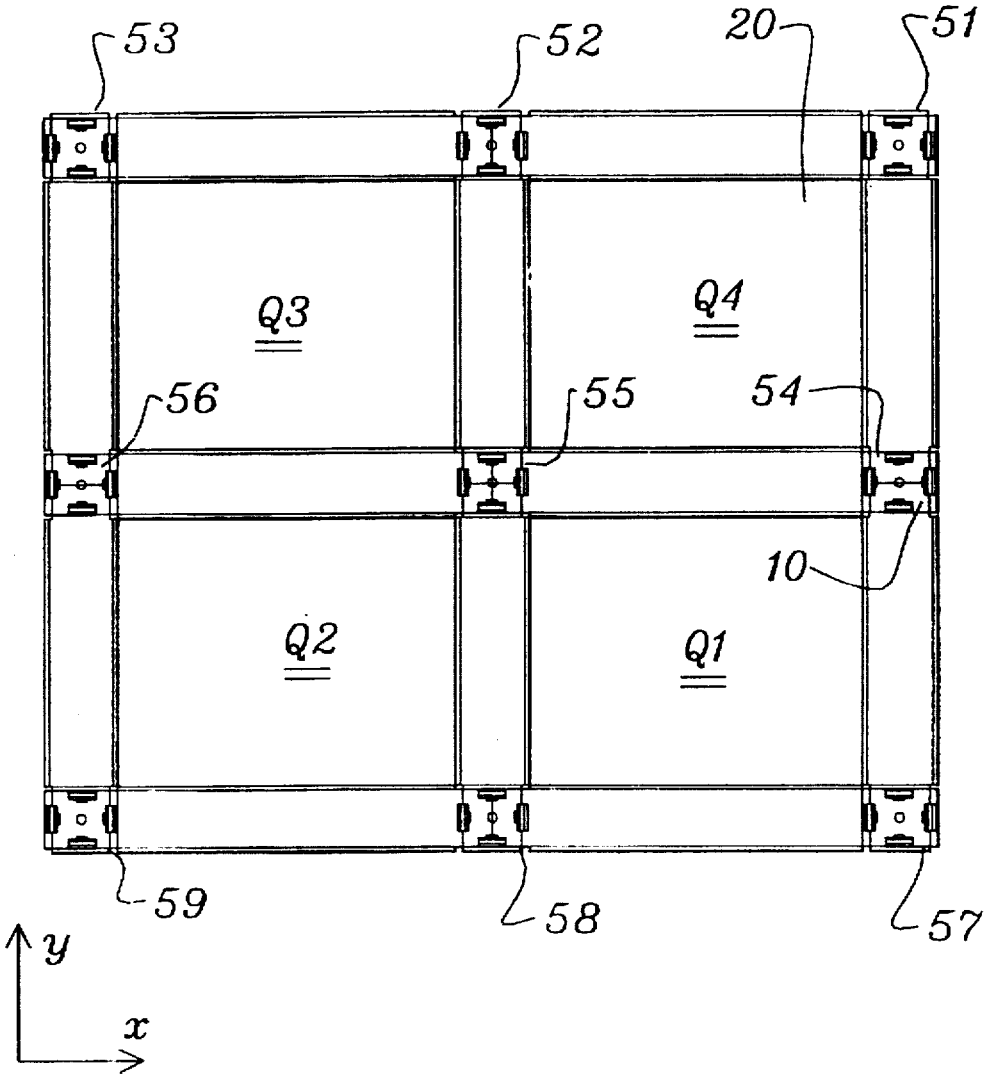
FIG. 15 is a bottom plan view of the modular pallet system when assembled.
Figure 16:
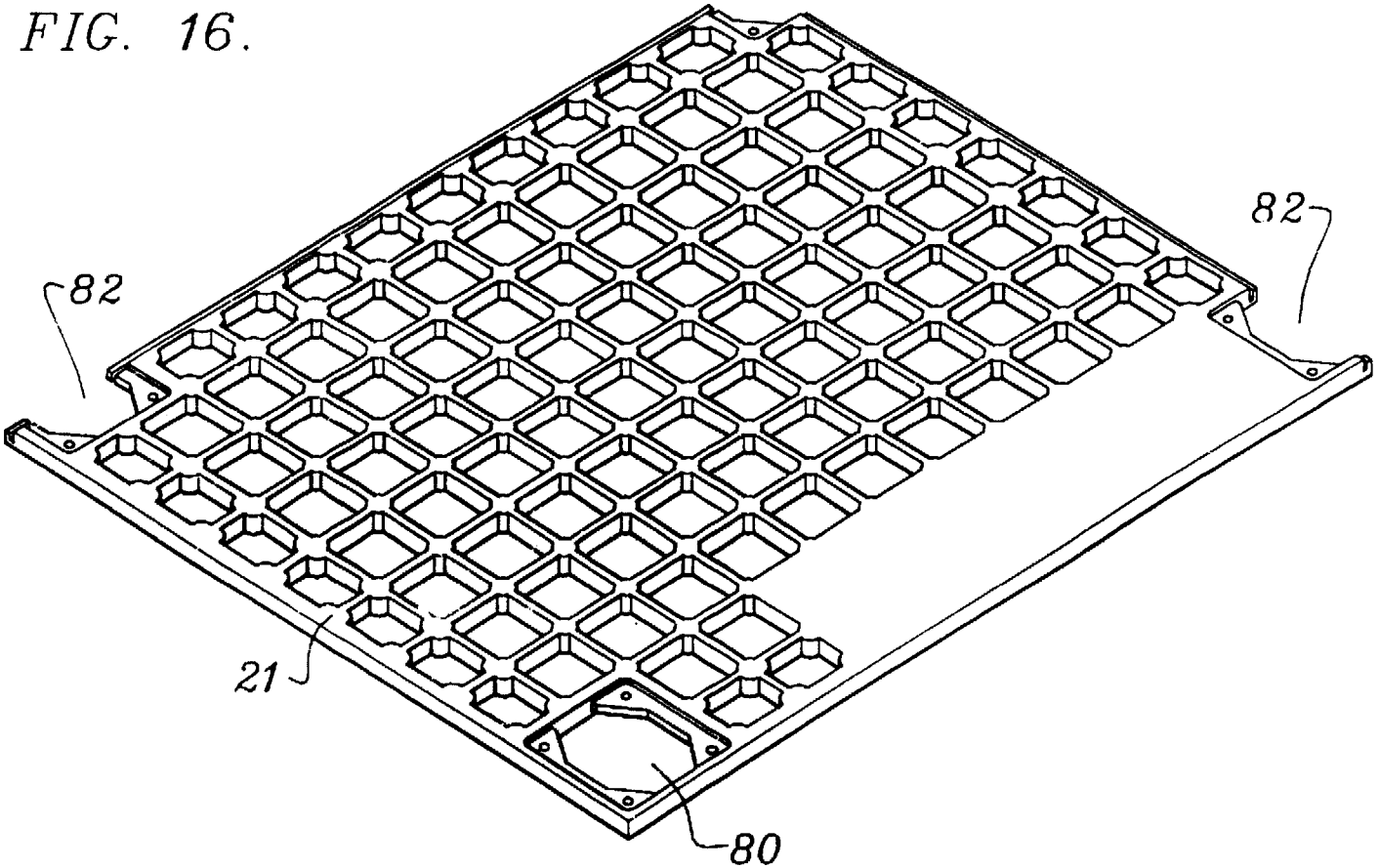
FIG. 16 is a perspective view of a quadrant of the honeycomb top layer of the present system.
Figure 17:
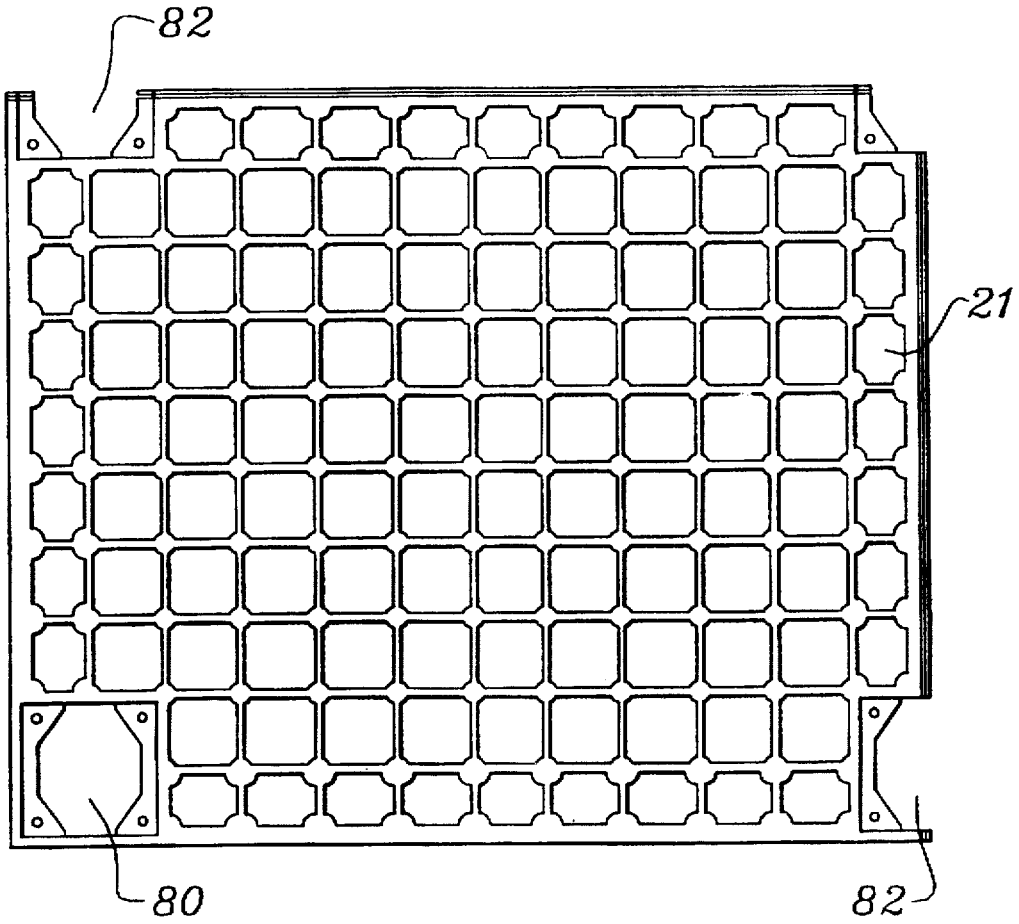
FIG. 17 is a top plan view of the top layer quadrant of FIG. 16.
Figure 18:
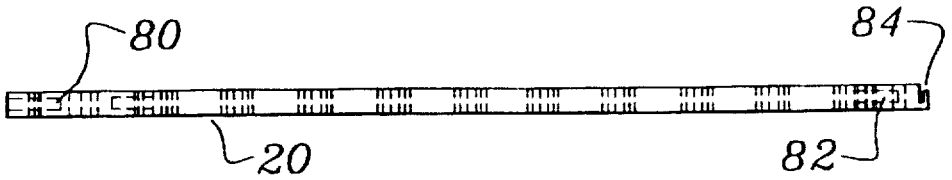
FIG. 18 is a side plan view thereof.

With reference to FIG. 15 may be seen, in the bottom view, a structure resultant from the assembly of nine of the above described components formed of a combination of top elements, bottom elements and the x/y axis separation means. The location of each of the separation means is denoted by the designations S1 thru S9 in FIG. 15, as is the location of quadrants Q1 thru Q4 of the top layer defining honeycomb structure 21. Each of these quadrants may, more particularly, be seen in the views of FIGS. 16, 17 and 18. It may be noted that an octagonal opening of the type shown as opening 80 may be used at each of the corners, that is, locations S1, S3, S7 and S9 of the present structure through simply rotating the structure of FIG. 16 and/or inverting the same. The z-axis separation means at the other location, namely, S2, S4, S5, S6 and S8 may be accommodated through the one-half octagonal openings 82 which are shown in the structure of FIGS. 16 to 18.

Figure 19:
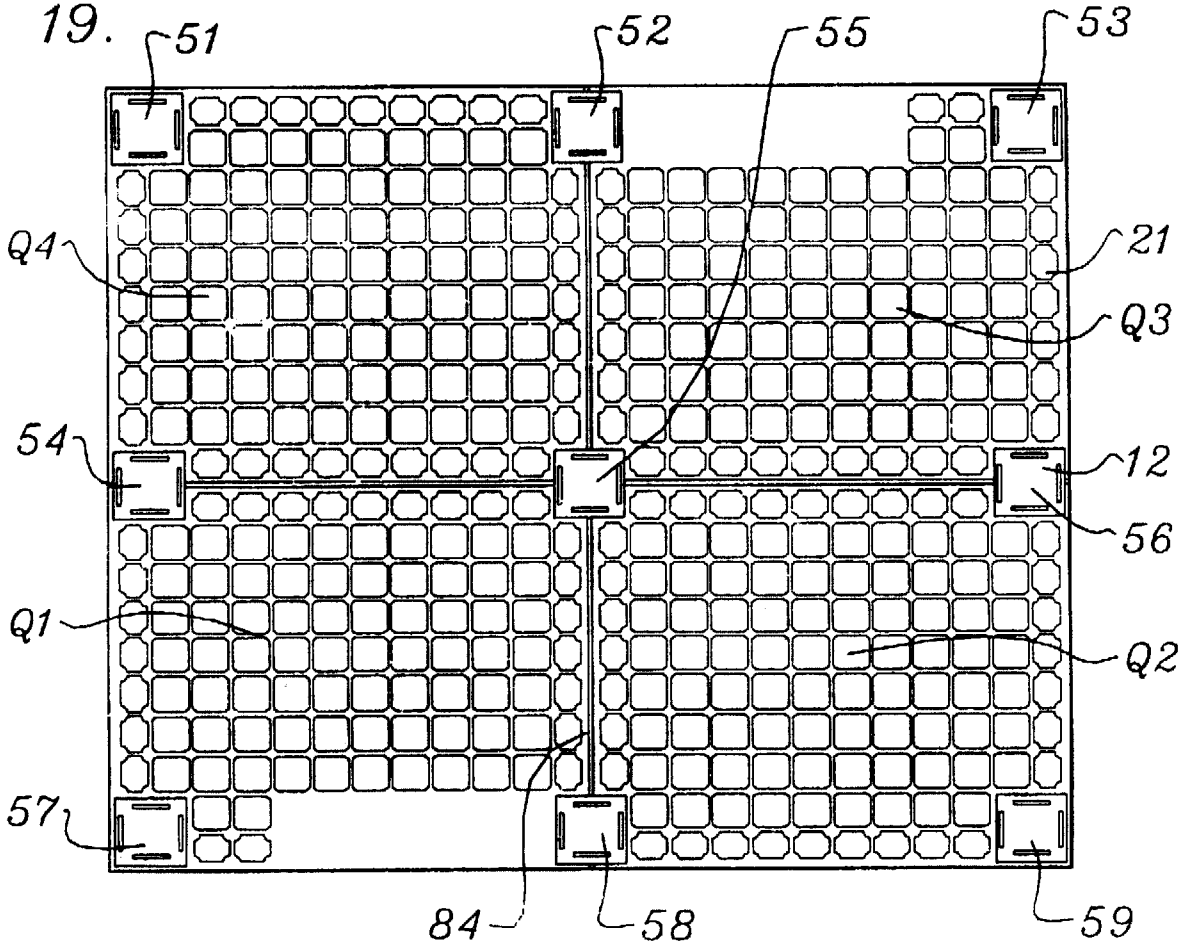
FIG. 19 is a top plan view of the assembled pallet system.

In FIG. 19 is shown a top plan view of the entire inventive pallet system when assembled. As may be noted (see FIGS. 18 and 19) there is provided complemental interlock surfaces which enable male and female parts of lip means 84 to slide-fittably connect four of the structures 21 to each other to form the entire system shown in FIGS. 15 and 19.

Figure 20:
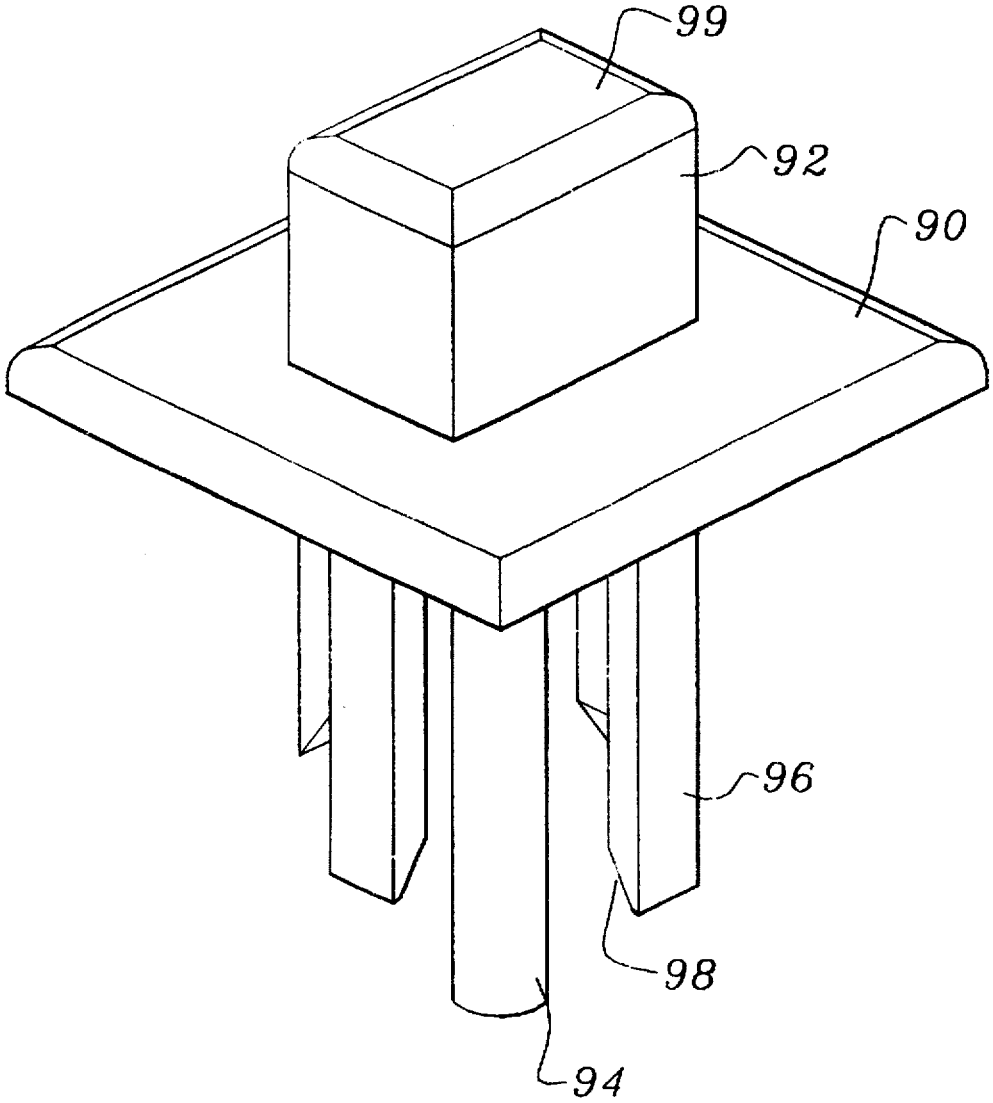
FIG. 20 is a perspective view of a tool used in the disassembly of the present system.

With reference to FIG. 20, there is, therein shown a disassembly tool 90 including a handle 92, a central circular member 94 and lateral members 96, each having inclined surfaces 98. Said members 94 and each of members 96 are proportioned for insertion into openings 50/150 and 52/152 of the bottom and top elements respectively. The position of inclined surfaces 98 of the lateral members 96 is such that the application of a sufficient force or impact to surface 99 of handle 92 will cause the loosing of the above-described interlock of the complemental engagement means shown in FIGS. 11 and 12.

Figure 21:
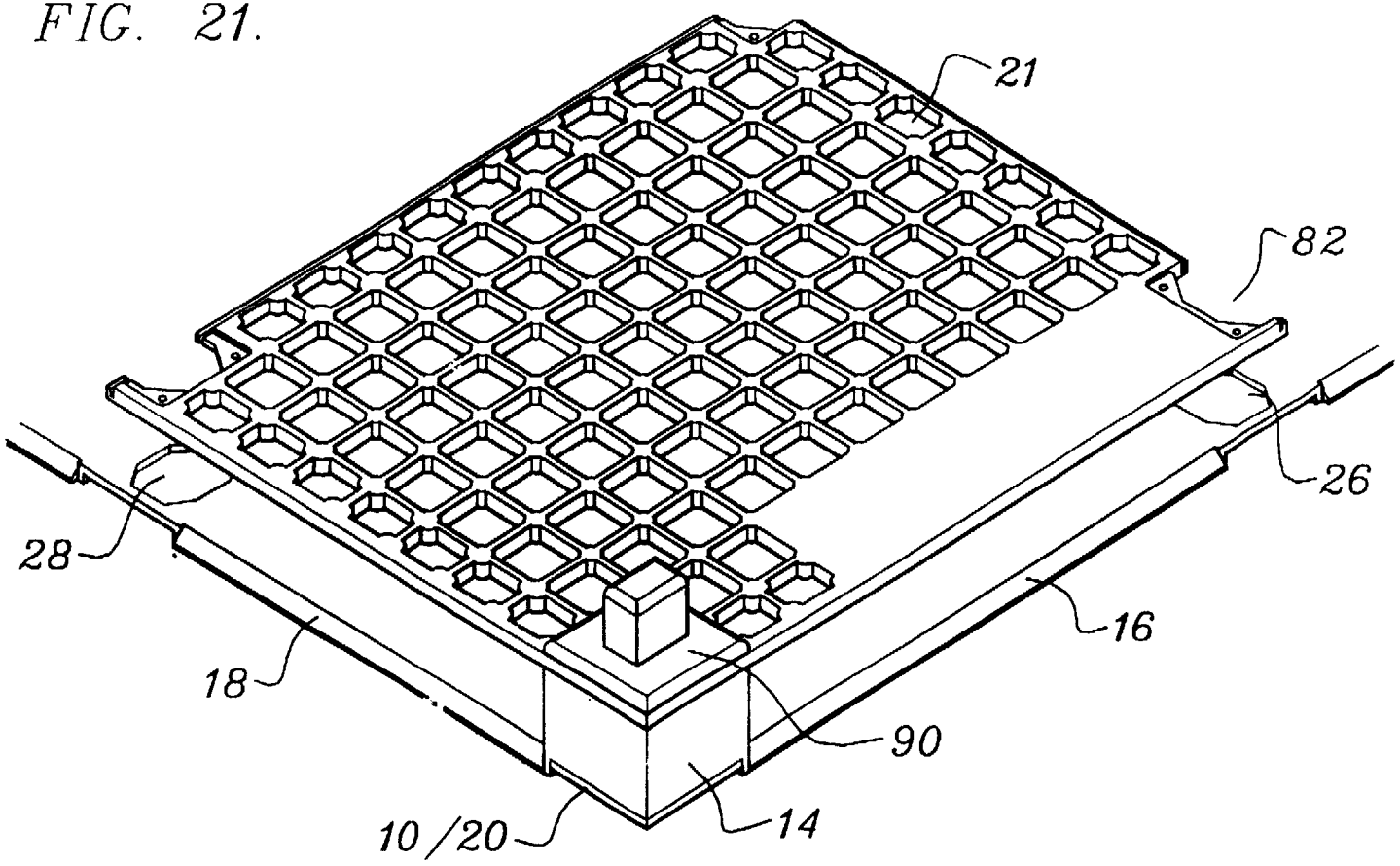
FIG. 21 is a perspective view showing insertion of the tool of FIG. 20 into a component defined by the combination by the bottom element, top element and box-like z-axis separation means.

The manner of insertion of the tool 90, into location S7 of the pallet system shown in FIG. 19, is shown in FIG. 21. Therein, members 94 and 96 have been fully inserted through the openings 150 and 152 respectively of the top element 56. It is noted that each of the above set forth elements of the present invention may be molded and/or extruded using a high impact resistance thermoplastic polymer.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

We claim:

1. A modular pallet system, definable in terms of an xyz Cartesian matrix, the system comprising:

(a) a plurality of bottom elements, each having a rectilinear primary surface, said surface having opposing x and y axis edges, positionable in a first xy plane, said elements having integrally dependent positive z-axis prongs substantially at each of said x and y axis edges of said primary surface, each of said prongs terminating, at a positive z-axis end thereof, with first integral complemental engagement means;

(b) a plurality of top elements, each having a rectilinear primary surface having opposing x and y axis edges, said surface positionable in a second xy plane, above said first xy plane, said elements having integrally-dependent negative z-axis prongs substantially at each of said x and y axis edges of said primary surface, each of said prongs terminating, at a negative z-axis end thereof, with second integral complemental engagement means having inner and outer surfaces, the inner surface of each of said second engagement means proportioned for snap-fittable interlock with an opposing outer surface of a corresponding one of said first engagement means of said prongs of said bottom elements;

(c) a plurality of hollow box-like z-axis separation means having pairs of opposing xz and yz walls, and an open top and bottom within xy planes thereof, said walls and planes proportioned for internestable support of said primary surfaces of said top and bottom elements, interior surfaces of each of said walls including integrally-dependent means for snap-fittable interlock with outer surfaces of said second complemental engagement means of said prongs of said top elements;

(d) a base layer comprising x-axis and y-axis linear offset members for defining x-and-y axis dimensions between said pluralities of said separation means, said members having openings therein proportioned for engagement between said edges of said xy planes of said bottom elements and base edges of said separation means; and (e) a top layer positionable in the xy plane of said primary surface of said top elements, said top layer having openings therein proportioned for engagement between edges of said top elements and top edges of said separation means, whereby, upon interlock of opposing surfaces of said complemental engagement means of said top and bottom elements within a volume defined by said separation means, and the interlock of outer surfaces of said engagement means of said prongs of said top elements to said snap-fittable interlock means of said separation means, a structure having rigid xy, xz, and yz planes is thereby formed.

2. The system as recited in claim 1, in which said top layer comprises four interlockable quadrants within said upper xy plane of said top elements.

3. The system as recited in claim 2, in which said top layer defines a honeycomb-like structure.

4. The system as recited in claim 3, in which said upper and lower xy planes define a dimension sufficient to permit insertion therebetween of arms of a fork lift vehicle.

5. The system as recited in claim 4, in which each element of said system comprises a high impact resistant thermoplastic.

* * * * *